US005746479A

United States Patent [19]

Bodnar

[11] Patent Number: 5,746,479

[45] Date of Patent: May 5, 1998

[54] ARMREST ATTACHMENT FOR CHAIR

[75] Inventor: David A. Bodnar, Jenison, Mich.

[73] Assignee: Steelcase Inc., Grand Rapids, Mich.

[21] Appl. No.: 757,839

[22] Filed: Nov. 27, 1996

[51] Int. Cl.[6] ..... A47C 7/54

[52] U.S. Cl. ..... 297/411.26; 297/411.43; 297/411.23; 297/440.1; 297/440.16; 297/440.24; 297/411.42; 297/DIG. 2; 403/383

[58] Field of Search ..... 297/411.42, 411.43, 297/411.45, 411.23, 411.26, 440.1, 440.23, 440.16, 440.24, 188.14, DIG. 2, 411.2; 248/118, 346.04; 403/383, 376, 377, 380

[56] References Cited

U.S. PATENT DOCUMENTS

| | | | |
|---|---|---|---|
| D. 355,081 | 2/1995 | Scheper . | |
| 771,811 | 10/1904 | Collier | 297/440.16 |
| 2,141,700 | 6/1937 | Tinnerman . | |
| 2,208,196 | 5/1940 | Pitt . | |
| 2,236,753 | 4/1941 | Foster | 403/383 |
| 2,262,426 | 1/1940 | Hall . | |
| 2,281,902 | 5/1942 | Witz . | |
| 2,630,857 | 2/1953 | Cohen . | |
| 2,668,584 | 9/1954 | Greitzer . | |
| 2,714,546 | 7/1955 | Lesniak . | |
| 2,914,873 | 1/1959 | Brennan . | |
| 3,038,571 | 6/1962 | Clements . | |
| 3,245,090 | 4/1966 | Slimmer . | |
| 3,323,144 | 6/1967 | Ferris, Jr. . | |
| 3,376,065 | 4/1968 | Kernes . | |
| 3,468,568 | 9/1969 | Ulich . | |
| 3,716,935 | 2/1973 | Freiderichs . | |
| 3,822,079 | 7/1974 | Probber | 297/440.1 |
| 3,856,611 | 12/1974 | Markley . | |
| 3,993,351 | 11/1976 | Rodaway | 297/197.6 |
| 4,358,125 | 11/1982 | Charles . | |
| 4,380,885 | 4/1983 | Komagata | 403/383 |
| 4,576,351 | 3/1986 | Brink | 297/411.26 |
| 4,606,579 | 8/1986 | Douglass . | |
| 4,768,797 | 9/1988 | Friedrich . | |
| 4,840,390 | 6/1989 | Lockard et al. . | |
| 5,322,286 | 6/1994 | Atherton et al. | 297/188.14 |

FOREIGN PATENT DOCUMENTS

| | | | |
|---|---|---|---|
| 549892 | 12/1959 | Belgium | 297/440.23 |

OTHER PUBLICATIONS

"Prior armrest manufactured by Steelcase, Inc.".

*Primary Examiner*—Peter M. Cuomo
*Assistant Examiner*—Anthony D. Barfield
*Attorney, Agent, or Firm*—Price, Heneveld, Cooper, DeWitt & Litton

[57] ABSTRACT

An armrest is provided for attachment to a chair. The chair includes vertical tubular sections which form a portion of a chair frame with open upper ends. Each armrest has a metal reinforcement with an intermediate section and downwardly protruding end sections, the end sections having an intermediate bent portion and two spaced apart portions such that the bent portion and the spaced apart portions define a dimension adapted to frictionally engage the open ends of the upright tubes. The metal reinforcement is formed from a steel rod weldment and a urethane cover is molded onto the rod weldment to support a user's forearm. To assemble the armrests, the end sections are pressed into the open ends of the vertical tubes, thus providing an easily assembled, secure and stable attachment of the armrest to the chair frame.

18 Claims, 3 Drawing Sheets

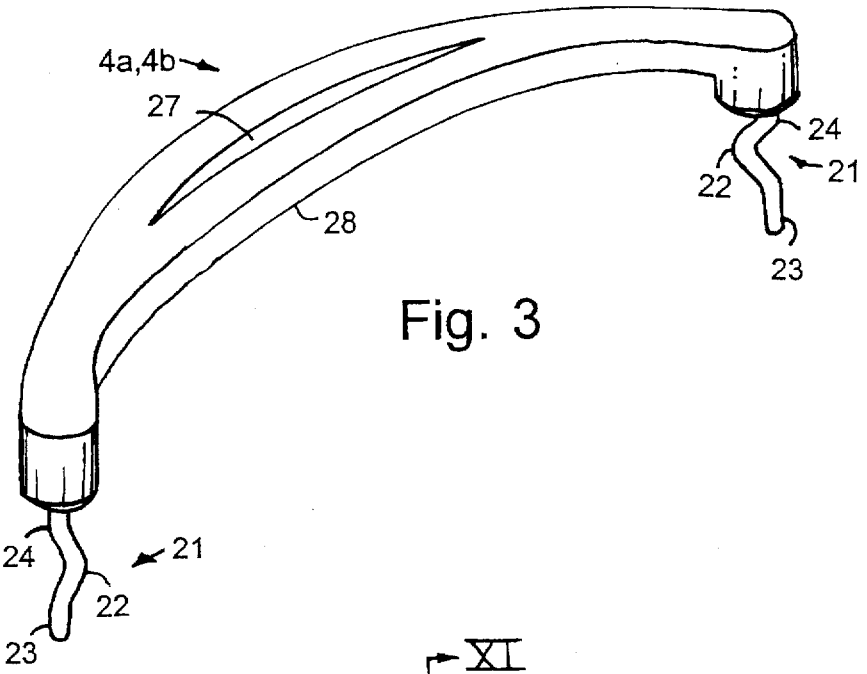
Fig. 3
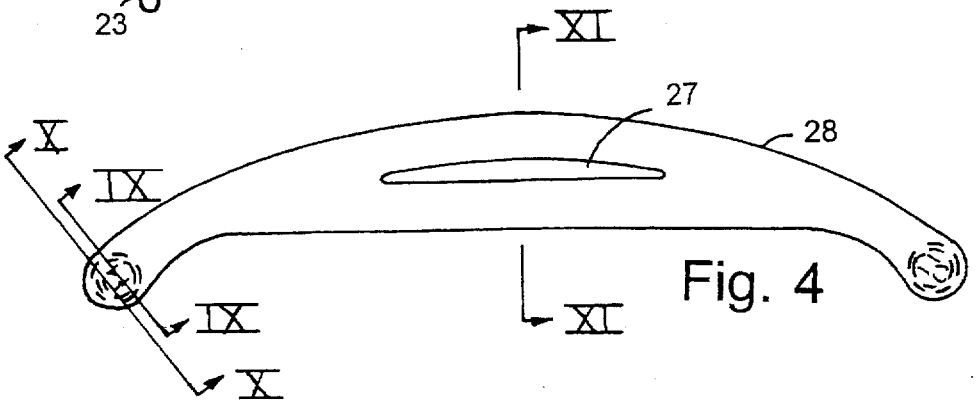
Fig. 4
Fig. 5
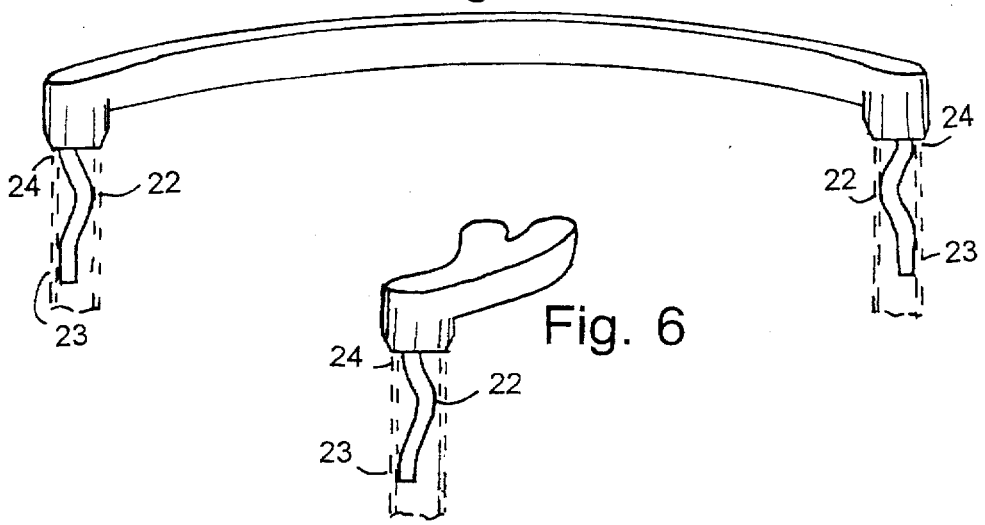
Fig. 6

ARMREST ATTACHMENT FOR CHAIR

BACKGROUND OF THE INVENTION

This invention relates to an armrest for a chair having a tubular frame, the armrest having a metal frame with end sections which are configured to frictionally engage the frame of the chair.

Chair armrests are usually manufactured separately, and then assembled to a chair during the final stages of manufacture. Various methods for attaching armrests are known in the art. One method used in the past included pressing a male member having a tapered portion frictionally into a tube forming part of a chair frame. However, small changes in the dimensions of the male member or the tube result in large changes in the amount of force required to insert or remove the male member. Therefore, this prior art armrest attachment requires close tolerances when manufactured to create the necessary friction for secure engagement while simultaneously avoiding excessive friction which would make assembly difficult. In addition, this prior art armrest attachment method is not as self-aligning during insertion as desired, and therefore it often requires additional effort to attach the armrest to the chair frame correctly. Other prior art attachment methods include the use of fasteners or spring devices which are not easily assembled and involve "extra" parts. These attachment methods not only undesirably increase the cost of the chair, but also often detract from the appearance of the chair.

Therefore, there is a need for an armrest having an attachment that overcomes the above problems and that provides an inexpensive, secure attachment which does not require fasteners or precise tolerances. Further, an armrest attachment method is desired that is self-aligning, and further that allows for quick attachment without use of complex machinery. Still further, there is a need for an attachment method that does not become loose over a period of time, and also that provides an uncluttered, aesthetically pleasing appearance.

SUMMARY OF THE PRESENT INVENTION

The present invention includes an armrest having a metal reinforcement with an intermediate section and downwardly protruding configured sections. The configured sections have vertically and horizontally spaced apart portions for frictionally engaging open ends of a tubular chair frame. The armrest includes a polymeric body molded to the metal reinforcement and adapted to support for a seated user's forearms.

The present invention provides numerous advantages over the prior known armrest attachment articles and methods for chairs. The attachment is simple and secure, and is configured to minimize the steps required for assembly. In particular, the armrest can be easily and securely press-fittingly attached to a chair frame without the use of separate fasteners. The ends of the armrest are self-aligning, and may be pressed into the tubes by automatic machinery, or manually with a mallet. In addition, the armrest attachment also does not require precise tolerances to create an adequate, but not excessive, frictional engagement in the chair frame. The simplicity, ease of assembly, and lower tolerance requirements provide a low-cost, durable armrest attachment. The absence of externally visible fasteners provides an aesthetically pleasing appearance.

These and other features, objects and advantages of the present invention will become apparent upon reading the following description thereof together with reference to the accompanying drawings.

BRIEF DESCRIPTION OF DRAWINGS

FIG. 3 is a perspective view of the armrest shown in FIG. 2;

FIG. 4 is a top view of the armrest shown in FIG. 2;

FIG. 5 is a side view of the armrest shown in FIG. 2, the open top ends of the vertical frame tubes being shown in phantom lines;

FIG. 6 is a fragmentary elevational view illustrating one end of the armrest in engagement with a tube;

DETAILED DESCRIPTION OF THE PREFERRED EMBODIMENT

Figure 1:
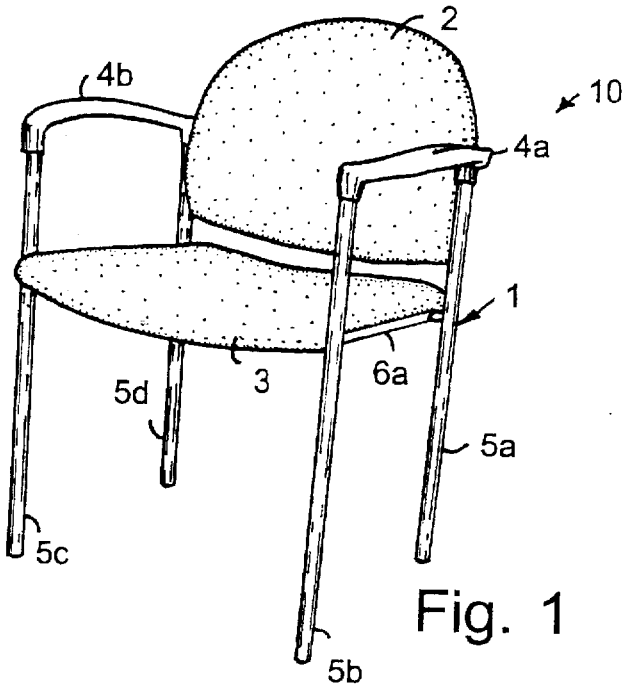
FIG. 1 is a front perspective view of a chair incorporating the present invention.
Figure 2:
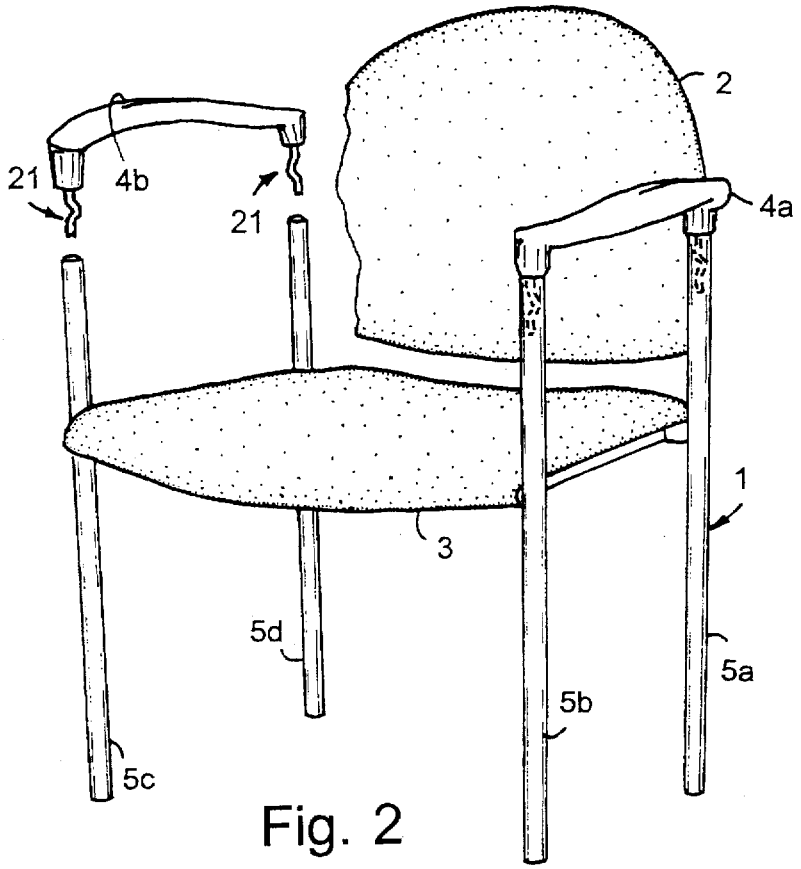
FIG. 2 is a partially exploded, perspective view of the chair shown in FIG. 1 illustrating the configured end sections of the armrests.

For purposes of description herein, the terms "upper", "lower", "right", "left", "rear", "front", "vertical", "horizontal", and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Chair 10 (FIG. 1) includes a frame 1, a backrest 2, a seat portion 3, and a pair of armrests 4*a* and 4*b*. Frame 1 preferably includes tubular sections including substantially vertical tubes 5*a*, 5*b*, 5*c* and 5*d*, and horizontal tubes welded together to form a rigid rectangular framework, although the present invention is contemplated to include other chair frame constructions. Each pair of tubes 5*a*, 5*b* and 5*c*, 5*d* respectively form a left and right pair of legs.

As best seen in FIGS. 3–8, the armrests 4*a* and 4*b* have a metal reinforcement 20 with configured end sections 21, and an outer, urethane cover, or body 28 molded onto reinforcement 20. Armrests 4*a* and 4*b* are mirror images, and accordingly only armrest 4*a* is described hereinafter. It is contemplated that the armrests could be made identical.

Figure 7:
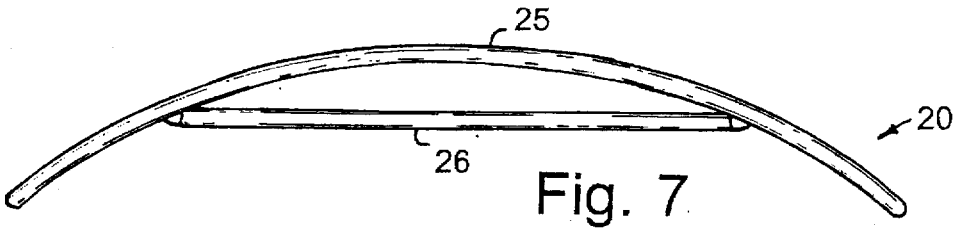
FIG. 7 is a top view of the reinforcement rod portion of the armrest shown in FIG. 2.
Figure 8:
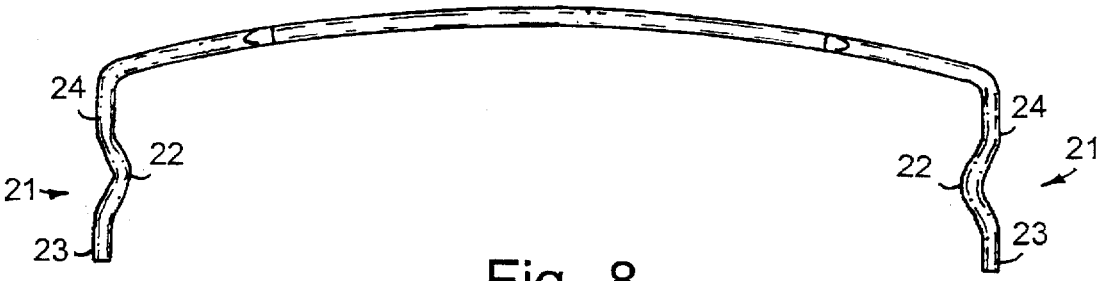
FIG. 8 is a side elevational view of the reinforcement rod shown in FIG. 7.

As best seen in FIGS. 7 and 8, the metal reinforcement 20 is preferably formed from a steel rod having a circular cross section. The intermediate section of the metal reinforcement 20 has a first elongate intermediate curved portion 25, and further has a second elongate bar portion 26 welded to the first curved portion 25 to provide increased width and strength for supporting a seated user's forearm. The first curved portion 25 extends generally arcuately in a horizontal plane, but with a slight vertical curve. The second elongate bar 26 is substantially straight when viewed from above but with a slight vertical curve corresponding to that of the first curved portion 25. (See FIG. 8). The metal reinforcement 20 has configured end sections 21 that extend vertically and substantially perpendicular to the curved portion 25 and the second elongate portion 26. The distance between the two end sections 21 corresponds to the distance between a pair of upright, spaced apart tubes such as tubes 5*a* and 5*b*.

Figure 9:
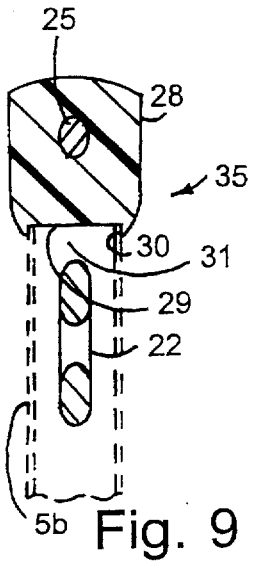
FIG. 9 is a section view taken along the plane IX—IX of FIG. 4.
Figure 10:
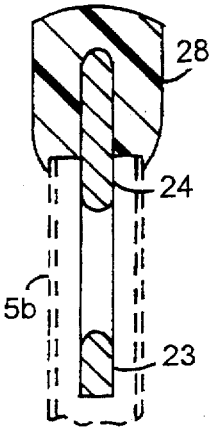
FIG. 10 is a sectional view taken along the plane X—X of FIG. 4.
Figure 11:
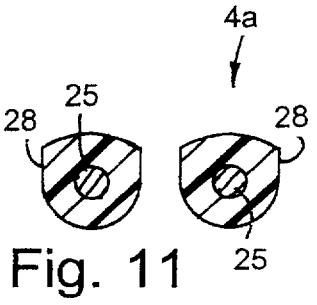
FIG. 11 is a sectional view taken along the plane XI—XI of FIG. 4.

As best seen in FIGS. 3, 4, and 5, the intermediate section of the metal reinforcement 20 is covered with a molded polymeric or urethane body 28 for comfortable support of a seated user's forearm. The urethane body 28 defines a D-shaped aperture 27 in plan view (FIG. 4), which not only provides a distinctive appearance, but that also can be used for grasping by a seated user that is beginning to stand up. As best seen in FIG. 9, the body 28 has end portions 35 adapted to act as stops to limit the engagement of the configured end sections 21 in the open, upper ends of the tubes 5*a*, 5*b*, 5*c* and 5*d*. The end portions 35 include an annular inner lip 30 and a circular flat surface 29 which form a cavity 31 for receiving the open, upper end of one of the tubes 5*a*, 5*b*, 5*c* and 5*d*. As seen in FIG. 9, the circular flat portion 29 of the body 28 acts as a stop to limit the length of the end sections 21 that extends into the tubes. When the armrest is fully installed to the frame, the end portion of the tubes is received into the body 28, thereby covering the edges of the tube. The connection between the armrests 4*a*, 4*b* and the chair frame 1 is therefore free of unsightly sharp or rough edges.

As best seen in FIGS. 2, 3, 5 and 6, each of the end sections 21 of the armrests 4*a* and 4*b* have an intermediate portion 22 and vertically spaced apart portions 23 and 24 that frictionally engage opposing inner surfaces of the tubes 5*a*, 5*b*, 5*c* and 5*d* near the open, upper end of the tubes. The intermediate portion 22 and vertically spaced apart portions 23 and 24 are formed by three adjacent bends in the metal reinforcement 20. Intrmediate portion 22 forms a transversely-oriented U-shaped bend that contacts the inner surface of the tubes 5*a*, 5*b*, 5*c* and 5*d*. The U-shaped bend has upper and lower legs forming vertically spaced-apart portions 23 and 24. Two vertically spaced apart portions 23 and 24, are horizontally spaced apart by the intermediate bent portion 22 such that the horizontal or transverse dimension "H" defined by the intermediate portion 22 and vertically spaced apart portions 23 and 24 is somewhat greater than the inside diameter of the tubes 5*a*, 5*b*, 5*c* and 5*d*. This causes an interference fit when the end sections 21 are installed in the tubes. Therefore, the end sections 21 and/or the tubes 5*a*–5*d* resiliently bend slightly when the end sections 21 are inserted into the open, upper ends of tubes 5*a*, 5*b*, 5*c* and 5*d*. The intermediate portion 22 and the spaced apart portions 23 and 24 are biased into frictional engagement with inner surface of the tubes due to the force resulting from the bending of the end sections 21. The amount of force required to insert or remove the end sections can be varied by changing the amount of interference between the end sections 21 and the inner surfaces of the tubes 5*a*, 5*b*, 5*c* and 5*d*, or by varying the diameter or surface finish of the rod which forms the end section 21. The armrests 4*a* and 4*b* are thereby securely attached to the tubes due to the frictional engagement of the end sections 21 in the ends of the tubes. The spaced apart portions 23 and 24 preferably lie in the same plane as intermediate portion 22, although it is conceivable that a non-planar arrangement could also be developed.

During installation of the armrests 4*a* and 4*b* to the chair frame 1, initially only the intermediate portion 22 and the spaced-apart portion 23 are placed into and contact the inner surface of the tubes. As the end section 21 is urged further into the tube, the spaced-apart portion 24 comes into contact with the upper edge of the tube opening. This contact between the two curved surfaces causes the end section 21 to align with the axis of the tube. The engagement of the intermediate portion 22 and the spaced-apart portions 23 and 24 with the cylindrical inner surface of the tubes also resists an overturning moment, such that the armrest does not tend to twist out of engagement during installation.

As will now be apparent, the end sections of the armrests have a shape that is configured to be securely and easily engaged with the open ends of the upright tubes of the chair frame. The armrests end sections may be inserted by means of special equipment or manually with a mallet. The shape and dimensions of the end sections provide secure engagement while still allowing for simple assembly. Notably, it is envisioned that the armrest could be manufactured in several different configurations, such as with separate configured end pieces attached to a main body formed of a structural polymer or other material.

It will become apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A chair comprising:

a frame including a pair of spaced apart tubes having open ends; and a pair of armrests, each armrest including a reinforcement rod with an intermediate section and configured end sections extending from said intermediate section, said configured end sections of said reinforcement rods each defining a transversely-oriented U-shaped bend with upper and lower legs and a curved intermediate portion defining a transverse dimension greater than a diameter of said open ends when in a disassembled condition to provide an interference fit such that insertion of said end sections into said open ends frictionally retains said armrests to said frame.

2. The chair defined in claim 1, wherein said upper and lower legs are supported by said intermediate section to resiliently bend slightly upon insertion of said end sections into said open ends of said tubes to create a stable and secure frictional connection.

3. The chair defined in claim 1, including a body molded of a polymeric material onto said intermediate section of said reinforcement rod, said body having an end portion adjacent said configured end section of said reinforcement rod, said end portion defining a cavity having an annular inner lip, said end of said tubes being closely received within said cavity and contacting said annular inner lip to thus provide a visually attractive covering of the ends of said tubes.

4. The chair defined in claim 1, wherein said configured end sections of said reinforcement rod have a substantially uniform cross-sectional shape therealong.

5. The chair defined in claim 4, wherein said reinforcement rod is steel with a circular cross-sectional shape.

6. The chair defined in claim 5, wherein said body defines an aperture through said intermediate section.

7. The chair defined in claim 6, wherein said cavities of said end portions define a flat circular surface adapted to act as stops to limit the engagement of said configured end sections in said open ends.

8. The chair defined in claim 7, wherein said frame comprises at least a pair of legs that include the spaced apart tubes defining said open ends.

9. The chair defined in claim 7, wherein said spaced apart tubes form legs for the chair and include lower ends adapted to rest on a floor surface.

10. An armrest for attachment to a chair, the chair having a frame which has tubular sections with open ends, the armrest comprising:

an elongated metal reinforcement having downwardly protruding configured sections shaped to slidingly extend into the open ends and configured to resiliently frictionally engage an inside of the tubular sections, each of said configured sections including a U-shaped bend having upper and lower legs and a curved intermediate portion therebetween, said upper and lower legs and said intermediate portion having contact surfaces adapted to frictionally engage an inner surface of the open ends and said curved intermediate portion for providing sufficient structural support to the upper and lower legs to stably and securely retain the armrest to the frame.

11. The armrest for a chair defined by claim 10, further including a polymeric body molded to said reinforcement for aesthetically and comfortably supporting a seated user's forearm, said polymeric body being characterized by an absence of material extending into the open ends for retaining the armrest to the frame.

12. The armrest for a chair defined in claim 11, wherein said configured sections are formed from bent wire rod having a circular cross-sectional shape that is substantially uniform therealong, said upper and lower legs of said U-shaped bend defining upper and lower contact surfaces that are configured to contact the inner surface of the tubular section on one side and the intermediate portion having a middle contact surface facing oppositely from said upper and lower contact surfaces that is configured to contact the inner surface of the tubular section on another side of the inner surface, said upper, lower, and middle contact surfaces defining a dimension transverse to an installation direction that is adapted to frictionally engage one of the open ends.

13. The armrest for a chair defined in claim 11, wherein said polymeric body defines a D shape.

14. The armrest for a chair defined in claim 13, wherein said metal reinforcement is formed from metal rods that are welded together to form the D-shape.

15. A chair comprising:

a seat;

a frame having at least four substantially vertical tubes forming chair legs, each tube defining a vertical centerline and having a substantially uniform, circular tubular cross-sectional shape with inner and outer surfaces that define inner and outer diameters, the tubes having upwardly open ends, the frame further including four rods connected to said chair legs forming a support for said seat;

a pair of armrests, each including a metal rod having a constant outer diameter that is substantially less than said inner diameter of said chair legs, said rod having an elongate intermediate portion and end sections oriented generally perpendicular to said elongate intermediate portion, said end sections having a transversely-oriented U-shaped bend defining upper and lower legs and a curved intermediate portion therebetween, said upper leg defining an upper contact surface that contacts said inner surface of one of said chair legs;

said lower leg defining a lower contact surface that contacts said inner surface of said one chair leg below said upper contact-surface;

said curved intermediate portion defining an intermediate contact surface that contacts said inner surface of said one chair leg, said upper, lower, and intermediate contact surfaces defining a transverse dimension greater than said inner diameter of said tube when in an unassembled condition, said curved intermediate portion biasing said upper and lower legs of said U-shaped bend apart and into frictional engagement with said inner surfaces when said end sections are inserted into said open ends of said tubes such that said end sections frictionally, securely, and stably engage said inner surface when said armrests are assembled to said frame.

16. The chair defined in claim 15, wherein said upper contact surface defines an upper contact point, said lower contact surface defines a lower contact point, and said intermediate contact surface defines an intermediate contact point, said upper, lower, and intermediate contact points defining a vertical plane.

17. The chair defined in claim 16, wherein said end sections are formed from a substantially straight rod that is bent to form said transversely-oriented U-shaped bend.

18. A chair comprising:

a seat;

a frame having at least four substantially vertical tubular legs with upwardly facing open ends and structure forming a support for said seat;

a pair of armrests including a reinforcement made from metallic rod, the reinforcement having a first rod with an elongate intermediate curved portion and a second rod welded to said curved portion, both portions being encapsulated by a polymeric body to form a D-shape adapted to support a user's forearms, said armrests further having end sections oriented generally perpendicular to said elongate curved portion, said end sections each having at least two vertically spaced apart portions defined by bends in said metallic rods, and an intermediate portion defined by a bend in said metallic rod, said vertically spaced apart portions and said intermediate portion defining a horizontal dimension greater than an inner surface of said vertical tubes such that said end sections frictionally engage said inner surface when assembled thereto, wherein said two vertically spaced apart portions and said intermediate portion lie substantially in a vertical plane.

* * * * *

UNITED STATES PATENT AND TRADEMARK OFFICE

CERTIFICATE OF CORRECTION

PATENT NO. : 5,746,479
DATED : May 5, 1998
INVENTOR(S) : David A. Bodnar

It is certified that error appears in the above-identified patent and that said Letters Patent is hereby corrected as shown below:

Column 3, Line 37;

"Intrmediate" should be --Intermediate--.

Column 5, Claim 13, Line 42;

"claim 11" should be --claim 12--.

Signed and Sealed this

Twenty-fourth Day of November, 1998

*Attest:*

Bruce Lehman

BRUCE LEHMAN

*Attesting Officer*

*Commissioner of Patents and Trademarks*